US006470246B1

(12) United States Patent
Crane et al.

(10) Patent No.: US 6,470,246 B1
(45) Date of Patent: Oct. 22, 2002

(54) METHOD FOR CONTROLLING LATERAL POSITION OF AN UNDERWATER TOWED BODY

(75) Inventors: Jan W. Crane; Rafael R. Rodriguez, both of Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 15 days.

(21) Appl. No.: 09/823,008

(22) Filed: Apr. 2, 2001

(51) Int. Cl.[7] ..... B63G 8/14
(52) U.S. Cl. ..... 701/21; 114/244; 114/245
(58) Field of Search ..... 701/21; 114/242, 114/244, 245, 253, 254, 246, 312

(56) References Cited

U.S. PATENT DOCUMENTS 4,033,278 A * 7/1977 Waters ..... 114/245
4,055,138 A * 10/1977 Klein ..... 114/244
4,350,111 A * 9/1982 Boyce, III ..... 114/245
4,404,664 A * 9/1983 Zachariadis ..... 114/246
5,402,745 A * 4/1995 Wood ..... 114/244
6,011,752 A * 1/2000 Ambs et al. ..... 114/244
6,144,342 A * 11/2000 Bertheas et al. ..... 114/244
6,276,294 B1 * 8/2001 Geriene et al. ..... 114/312

* cited by examiner

*Primary Examiner*—Gary Chin
(74) *Attorney, Agent, or Firm*—Harvey A. Gilbert; Donald G. Peck

(57) ABSTRACT

A method of controlling the lateral position of a towed body in water where the body is equipped with effectors for effecting at least aileron and rudder control. A lateral correction is defined by a distance measured perpendicular to the towed body's direction of travel. A first command indicative of an aileron control is determined that would cause the effectors to move the body laterally of the direction of travel by an amount equal to the lateral correction. A second command indicative of a rudder control is determined that would cause the effectors to move the body laterally of the direction of travel by an amount equal to the lateral correction. The first and second commands are combined to define a combined command that is applied to the effectors so that the optimum aileron and rudder controls are implemented simultaneously.

10 Claims, 2 Drawing Sheets

METHOD FOR CONTROLLING LATERAL POSITION OF AN UNDERWATER TOWED BODY

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to towed body systems such as those equipped with onboard sensors capable of sensing parameters of an underwater area, and more particularly to a method of controlling the lateral motion and position of such towed bodies.

BACKGROUND OF THE INVENTION

Underwater searches and surveys are typically carried out by towing a sensor platform through the water. Many underwater sensors have a relatively small range and field-of-view. Consequently, a towed sensor platform carrying one or more sensors must be positioned almost exactly over a target or object of interest, hereinafter referred to simply as the "target".

Generally, a target's location is not known precisely. Therefore, it may not possible to plan a tow track that passes precisely over a target. Furthermore, the towed body's motion can be disrupted by water currents and wave action. In an attempt to address this problem, towed systems may have a forward-looking sonar that helps to reacquire the target shortly before reaching it. However, the range of the forward-looking sonar is limited. Thus, the advance time provided by the sonar detection is often too short to maneuver the entire system (i.e., the tow craft and towed body sensor platform) to assure that the sensing instrument passes over the target. If the target is missed (i.e., the target does not fall within the towed sensor(s) field-of-view), the entire maneuver must be repeated. This can be very time-consuming, depending on the system, the length of the tow cable, and the sea state conditions.

SUMMARY OF THE INVENTION

Accordingly, it is an object of the present invention to provide a method of controlling the lateral position of a body as it is towed through the water.

Another object of the present invention is to provide a method of quickly effecting lateral movement of a body as it is towed through the water.

Still another object of the present invention is to provide a method of controlling the lateral movement of a towed body equipped to effect aileron, elevator and rudder control.

Other objects and advantages of the present invention will become more obvious hereinafter in the specification and drawings.

In accordance with the present invention, a method of controlling the lateral position of a towed body in water where the body is equipped with effectors for effecting aileron, elevator and rudder control. The body is pulled through the water along a known direction of travel and in a defined frame of reference having one axis along the known direction of travel. A lateral correction is defined by a distance measured perpendicular to the one axis in the frame of reference. A first command indicative of an aileron control is determined that would cause the effectors to move the body laterally of the direction of travel by an amount equal to the lateral correction. A second command indicative of a rudder control is determined that would cause the effectors to move the body laterally of the direction of travel by an amount equal to the lateral correction. The first and second commands are combined to define a combined command that is applied to the effectors so that the optimum aileron and rudder controls are implemented simultaneously.

DETAILED DESCRIPTION OF THE INVENTION

Figure 1:
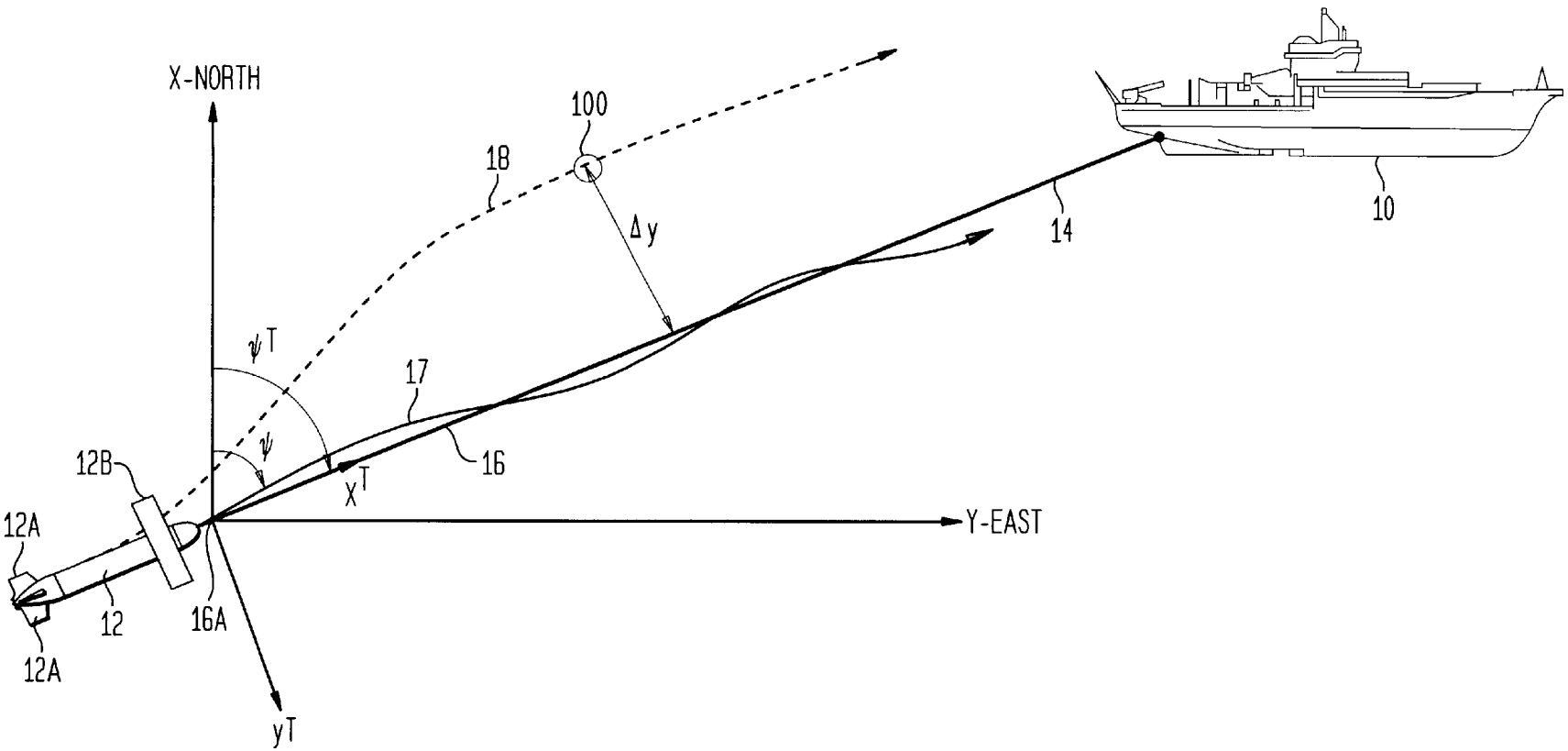
FIG. 1 is a schematic diagram of a towed body system in which the body being towed is to be laterally controlled/repositioned in accordance with the present invention.

Referring now to the drawings, and more particularly to FIG. 1, a towed body system includes a tow craft 10, a tow body 12 and a tow line 14 tethering tow body 12 to tow craft 10. Tow craft 10 pulls tow body 12 through a water environment along a nominal tow track 16. The actual track 17 traversed by tow body 12 can deviate slightly from track 16 due to water currents, disturbances in the motion of tow craft 10, etc. However, in most instances, this deviation is minor and will not have much impact on the method of the present invention.

Tow body 12 is equipped with a variety of control effectors (e.g., control surfaces, jets, etc.) that can effect aileron control actions for roll control, rudder control actions for yaw or heading control, and elevator control actions for pitch control. For example, tow body 12 can have tail fins 12A along with a depressor wing 12B (as illustrated) as its control effectors. Tail fins 12A can be installed in a number of well known configurations including cruciform, x-tail and inverted-Y configurations. Depressor wing 12B can be a fixed wing pre-set to a non-zero angle to generate lift, or a movable wing capable of being adjusted in terms of its (lift) angle. Accordingly, it is to be understood that the particular hardware configuration of the control effectors is not a limitation of the present invention.

By way of illustrative example, it will be assumed that tow body 12 is equipped with one or more onboard sensor systems (not shown) for detecting, imaging, localizing and/or classifying a target 100 which must fall within the sensor(s) field-of-view. However, it is to be understood that, in general, the present invention provides a method for the lateral position of any type of tow body. If target 100 is beyond the sensor(s) field-of-view, tow body 12 must be re-positioned laterally relative to tow track 16 before reaching target 100. Thus, the goal of the present invention is to effect lateral control of tow body 12 so that it will deviate from tow track 16 to a revised track 18 that captures target 100 within the tow body's sensor field-of-view.

A towed body having control effectors as described above can move laterally in one of two ways:

(1) If tow body 12 is rolled, the lift force produced by depressor wing 12B will be angled, resulting in a lateral force. Therefore, although aileron (roll) control is normally provided by tail fins 12A, they only have an indirect effect on lateral motion as they are only effective when depressor wing 12B is deflected. If the wing deflection is small (i.e., if tow body 12 is operating shallow water), the effect of tail fins 12A on aileron controlled lateral motion is weak. Even at deeper depths, the achievable lateral displacement is limited because the if tow body 12 rolls too much, target 100 will end up outside the sensor field-of-view. For these reasons, lateral control using aileron control is limited in its effectiveness.

(2) The rudder control using tail fins 12A produces a yaw angle that results in lateral displacement. This is the most effective way of achieving lateral motion. That is, large lateral position changes are possible using rudder control. This is especially true at shallow depths.

The above description suggests that lateral control of tow body 12 should be done using only rudder control. However, the problem of moving tow body 12 laterally onto revised track 18 does not simply involve moving tow body 12 a certain distance. Rather, the problem also requires that tow body 12 change its position fast enough so that target 100 ends up in the tow body's sensor field-of-view before tow body 12 passes target 100. The present invention is based on the discovery that lateral positioning control performance improves by using both rudder and aileron control simultaneously. Tow body 12 moves laterally faster in response to roll motion than to yaw motion. That is, aileron control of tow body 12 results in a very quickly executed roll maneuver. The resulting lateral force on depressor wing 12B due to the roll motion complements the rudder control by making tow body 12 move laterally faster than with rudder control only. Thus, combining the aileron and rudder control allows tow body 12 to achieve the dual goals of moving off-track enough to position itself close to or over target 100, and doing so quickly enough to reach the lateral position before passing target 100.

The control function of the present invention consists of three required elements:

1) A function that calculates the off-track position of target 100 relative to track 16. This off-track position becomes the control system's lateral position command.

2) A feedback control system that determines the ordered aileron control as a function of off-track error (i.e., the difference between the lateral position of tow body 12 relative to track 16 and the position of target 100), roll angle and roll rate.

3) A feedback control system that determines the ordered rudder control as a function of off-track error, track-relative yaw angle and yaw rate.

Another control function may be required if the depth of tow body 12 must be maintained/controlled. Such depth control can be required for certain types of onboard sensors such as an electro-optic camera. If required, the depth control function is a feedback control system that maintains the depth or altitude of tow body 12 above the bottom as it moves laterally. This ensures that the proper sensor altitude above target 100 is maintained. Without this control feature, tow body 12 could change depth as it moves, which may degrade the performance of some types of sensors.

The present invention assumes that the positions of tow body 12 and target 100 can be measured in a Cartesian (X-Y) coordinate system, with the X axis pointing north and the Y axis pointing east as illustrated in FIG. 1. This coordinate system is defined herein as the local reference frame. Also, it is assumed that motion measurements (e.g., roll, pitch, heading, and the corresponding angular rates, and depth or altitude) of tow body 12 are available. Measurement sensor/systems for providing these quantities are well known in the art and need not be described herein. Finally, it is assumed that nominal track 16 of tow body 12 is known. Track 16 is described by the local reference frame's X-Y coordinates for any point on track 16 and the track heading relative to north. The only restriction is that this point must be sufficiently close to target 100 so that the earth's surface between this point and target 100 can be assumed to be flat. The track direction is the same as the direction of travel of tow body 12.

The present invention's calculations are carried out in a track-relative Cartesian (X-Y) coordinate system referred to herein as the track reference frame. The origin of this system is located at a point 16A on track 16. The track reference frame's positive $X^T$ axis points along track 16 in the travel direction of tow body 12. The positive $Y^T$ axis is perpendicular to the $X^T$ axis and points to the right of track 16. The transformation of coordinates between the two reference frames is a well-known procedure described in any linear algebra textbook. See, for example, "Elementary Linear Algebra" by S. I. Grossman, Wadsworth Publishing Company, Inc. 1980, pp. 217–218. This transformation will be described briefly below.

If $(x^L,y^L)$ represents the X-Y coordinates of any point in the local reference frame, the coordinates of the same point in the track reference frame, $(x^T,y^T)$ are given by $$x^T=\cos(\psi^T)(x^L-x_0^L)+\sin(\psi^T)(y^L-y_0^L) \quad (1)$$

$$x^T=-\sin(\psi^T)(x^L-x_0^L)+\cos(\psi^T)(y^L-y_0^L) \quad (2)$$

In these equations, $(x_0^L, y_0^L)$ are the coordinates of the track origin point 16A and $\psi^T$ is the track heading with respect to north.

Figure 2:
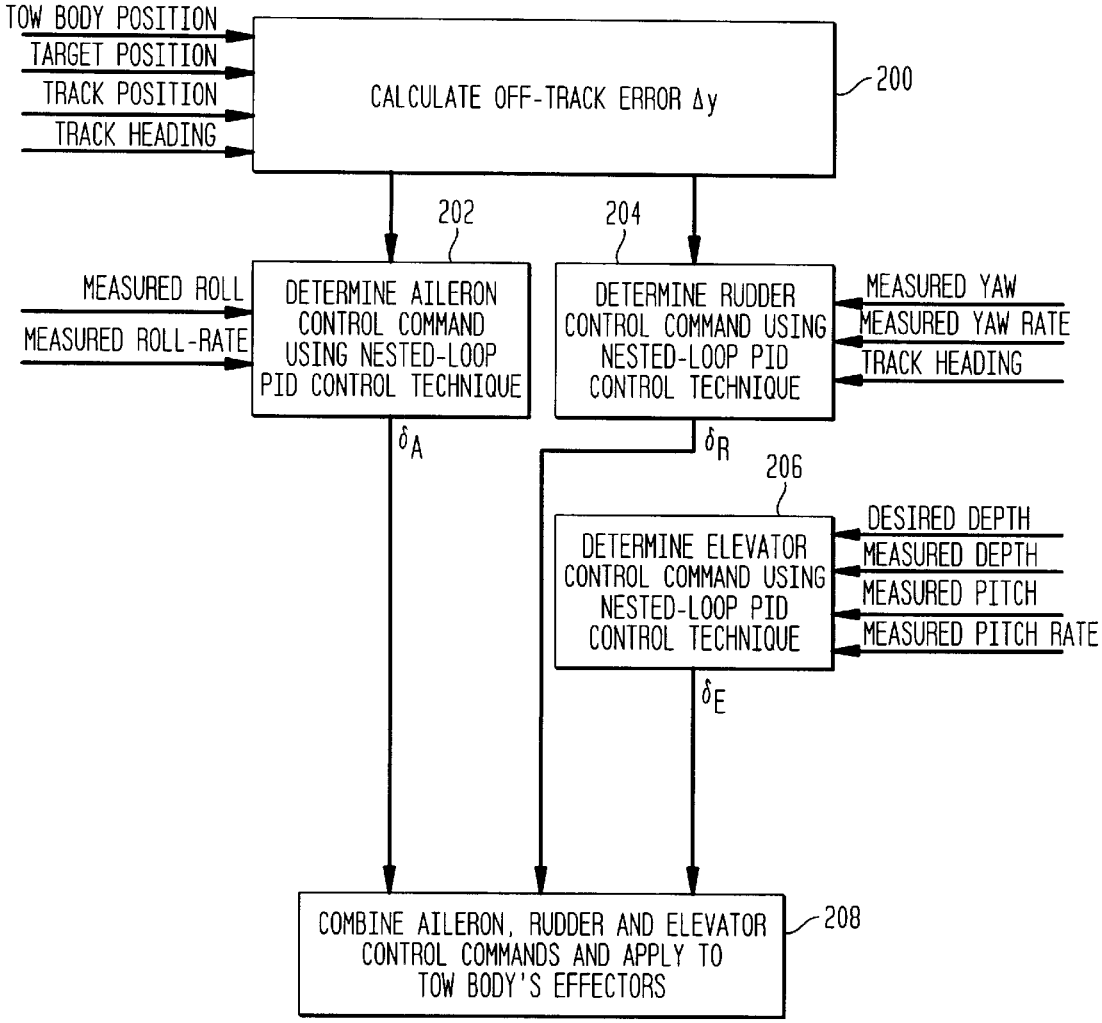
FIG. 2 is a flow diagram of the lateral position control method according to one embodiment of the present invention.

Referring additionally now to FIG. 2, one embodiment of the method of the present invention will be explained for the scenario illustrated in FIG. 1. The various measured parameters are indicated at the left of each block. At block 200, the off-track error $\Delta y$ is determined using the positions of tow body 12 and target 100, along with the position of track 16 and track heading $\psi^T$. The off-track error is defined as the difference between the Y coordinate locations of tow body 12 (traveling on track 16) and target 100 expressed in the track reference frame. Thus, if $(x_t^T,y_t^T)$ and $(x_b^T,y_b^T)$ represent, respectively, the target and tow body positions in the track reference frame, the off-track error $\Delta y$ is given by $$\Delta y=Y_t^T-y_b^T \quad (3)$$

The off-track error $\Delta y$ (depicted in FIG. 1) is the distance that tow body 12 must move laterally to position itself over target 100.

The present invention determines the aileron control command that would generate enough roll of tow body 12 required to move tow body 12 over target 100. Many feedback control design methods are available to perform this function without departing from the scope of the present invention. One method described herein by way of example is based on the classical Proportional-Integral-Differential (PID) feedback control technique. For a description of the PID feedback control technique, see for example, "Modern Control Engineering" by K. Ogata, Prentice-Hall, Inc., 1970.

In general, the PID control technique consists of a sequence of nested feedback loops. The outer loops generate control commands for the inner ones. The innermost loop computes the actuation command. In each loop, the computed signals are proportional to some error, or to the integral over time of some error, or to the rate of change of the error.

At block 202, the aileron control command $\delta_A$ can be determined using the nested-loop PID control technique. In determining the aileron control command, the PID control's outermost feedback loop computes a commanded/desired roll angle to achieve zero off-track error. This loop equation can be written as $$\phi_{com}=K_{yA}\Delta y+K_{iyA}\int(\Delta y)dt \quad (4)$$

where $\phi_{com}$ denotes the commanded roll angle for tow body 12 and $\Delta y$ is the off-track error computed in equation (3). The parameters $K_{yA}$ and $K_{iyA}$ are feedback gains which may be constant or variable. These gains are determined using standard closed-loop control design methods as is well known in the art.

The commanded roll angle $\phi_{com}$ passes to an intermediate feedback loop which generates a commanded roll rate. This loop equation can be written as $$\phi_{com(rate)}=K_{\phi A}(\phi_{com}-\phi)+K_{i\phi A}\int(\phi_{com}-\phi)dt \quad (5)$$

where $\phi_{com(rate)}$ is the commanded roll rate of tow body 12, and $\phi$ is the actual measured roll of tow body 12. The parameters $K_{\phi A}$ and $K_{i\phi A}$ are feedback gains. Finally, the innermost feedback loop computes the required aileron control command based on the commanded roll rate. This loop equation can be written as $$\delta_A=K_{pA}(\phi_{com(rate)}-\phi_{rate}) \quad (6)$$

where $\delta_A$ is a commanded aileron angle, $\phi_{rate}$ is the measured roll rate of tow body 12, and $K_{pA}$ is a feedback gain.

At block 204, the rudder control command $\delta_R$ can be determined using the nested-loop PID control technique. The present invention determines a rudder control command required to achieve zero off-track error by only yawing tow body 12. As in the case of the aileron control, any feedback control scheme can be used to design this function. The method described next is also a classical PID technique.

In determining the rudder control command, the outermost feedback loop computes a commanded heading angle (relative to nominal track 16) that is needed to move tow body 12 over target 100. The loop equation can be written as $$\psi_{com}=K_{yR}\Delta y+K_{iyR}\int(\Delta y)dt \quad (7)$$

where $\psi_{com}$ denotes the commanded heading angle for tow body 12, $\Delta y$ is the off-track error computed in equation (3), and the parameters $K_{yR}$ and $K_{iyR}$ are feedback gains which may be constant or variable. These gains are determined using standard closed-loop control design methods.

The commanded heading angle $\psi_{com}$ passes to an intermediate feedback loop which generates a commanded heading rate. This loop equation can be written as $$\psi_{com(rate)}=K_{\psi R}(\psi_{com}-\psi+\psi_T)+K_{i\psi R}\int(\psi_{com}-\psi+104_T)dt \quad (8)$$

where $\psi_{com(rate)}$ is the commanded heading rate of tow body 12. The parameters $\psi$ and $\psi_T$ are, respectively, the measured heading of tow body 12 (i.e., heading of actual track 17 with respect to north) and the heading of track 16 with respect to north. The parameters $K_{\psi R}$ and $K_{i\psi R}$ are feedback gains. Finally, the innermost feedback loop computes the required rudder control command based on the commanded heading rate. This loop equation can be written as $$\delta_R=K_{rR}(\psi_{com(rate)}-\psi_{rate}) \quad (9)$$

where $\delta_R$ is a commanded rudder angle, $\psi_{rate}$ is the measured heading rate of tow body 12, and $K_{rR}$ is a feedback gain.

If needed, the present invention's elevator control function is a feedback control loop that enables tow body 12 to maintain depth or altitude as it moves laterally to position itself over target 100. This control is needed when tow body 12 must be positioned at a fixed depth relative to target 100. For example, such depth control is required if tow body 12 houses an electro-optic camera (not shown). However, other types of sensors (e.g., a magnetic moment sensor) may not necessarily require use of depth control.

At block 206, the elevator control command $\delta_E$ can also be determined using the nested-loop PID control technique. The PID control equations described next are an example of an elevator control method. The control function again consists of three nested loops. The outermost feedback loop calculates a commanded pitch angle as a function of depth or altitude position error. As mentioned above, it is assumed that tow body 12 can determine its own depth and that the desired depth of tow body 12 is known. The outermost feedback loop equation for depth control can thus be written as $$\theta_{com}=K_z\Delta+K_{iz}\int\Delta dt \quad (10)$$

where $\theta_{com}$ denotes the commanded pitch angle for tow body 12, $\Delta$ is the depth or altitude position error, and the parameter $K_z$ is a feedback gain which may be constant or variable.

The commanded pitch angle $\theta_{com}$ passes to an intermediate feedback loop which generates a commanded pitch rate. This loop equation can be written as $$\theta_{com(rate)}=K_\theta(\theta_{com}-\theta)+K_{i\theta}\int(\theta_{com}-\theta)dt \quad (11)$$

where $\theta_{com(rate)}$ is the commanded pitch rate of tow body 12, $\theta$ is the measured pitch angle of tow body 12, and the parameters $K_\theta$ and $K_{i\theta}$ are feedback gains. The commanded pitch rate is passed to the innermost feedback loop to compute the required elevator angle. This loop equation can be written as $$\delta_E=K_q(\theta_{com(rate)}-\theta_{rate}) \quad (12)$$

where $\delta_E$ is a commanded elevator angle, $\theta_{rate}$ is the measured pitch rate of tow body 12, and $K_q$ is a feedback gain.

The commanded aileron angle $\delta_A$, commanded rudder angle $\delta_R$ and, if needed, the commanded elevator angle $\delta_E$ are combined at block 208 to yield a comprehensive command for controlling the entirety of the tow body's control effectors. In the illustrated example, the two (or three) commanded angles $\delta_A$ and $\delta_R$ (and, if needed, $\delta_E$) are combined to yield the command angles for tail fins 12A. The mathematical combining operation is not necessarily a straight addition operation as the particular combining operation depends on the convention that the towed body's design uses to define positive and negative tail fin deflections. For example, if tail fins 12A are defined by an inverted-Y tail fin configuration having left, right and top tail fins, the corresponding angles $\delta_{LEFT}$, $\delta_{RIGHT}$ and $\delta_{TOP}$ combine the commanded aileron angle $\delta_A$, commanded rudder angle $\delta_R$ and commanded elevator angle $\delta_E$ as follows:

$$\delta_{RIGHT}=\delta_A-(0.5)\delta_R-\delta_E \quad (13)$$

$$\delta_{LEFT}=-(-\delta_A-(0.5)\delta_R)\delta_R+\delta_E \quad (14)$$

$$\delta_{TOP}=-\delta_{A+\delta R} \quad (15)$$

Obviously, for other tail fin configurations, there will be different conventions.

The equations of the lateral control procedure described herein can be implemented by analog or digital means. In an analog mode, a mechanical or electrical circuit evaluates the equations to produce continuous updates of the tail fin commands. More commonly, the equations will be implemented in a digital computer or digital signal processor. In this case, the equations are evaluated in a cycle. The rate of cycle execution depends on the dynamic characteristics of tow body 12 and its control effectors, and is determined using standard control design methods as is well known in the art. In each cycle, the digital controller receives/processes motion measurements of tow body 12, position and orientation of track 16 and the location of target 100, in order to output the control effector commands.

The advantages of the present invention are numerous. A towed body can be optimally positioned to conduct its survey/data collection functions. Such positioning is achieved by determining commands for the tow body's control effectors significantly reducing the time required to complete a survey by decreasing the chances that the target will be out of the sensor field-of-view as the target is passed. The control method is effected without the need to maneuver the tow craft.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A method of controlling the lateral position of a towed body, comprising the steps of:

providing a body in water, said body being equipped with means for effecting aileron, elevator and rudder control thereof;

pulling said body through the water along a known direction of travel;

defining a frame of reference having one axis along said known direction of travel;

defining a lateral correction to said known direction of travel in said frame of reference, said lateral correction defined by a distance measured perpendicular to said one axis;

determining a first command indicative of an aileron control that would cause said means for effecting to move said body laterally of said direction of travel by an amount equal to said lateral correction;

determining a second command indicative of a rudder control that would cause said means for effecting to move said body laterally of said direction of travel by an amount equal to said lateral correction;

combining said first command and said second command to define a combined command; and applying said combined command to said means for effecting.

2. A method according to claim 1 wherein said body is further equipped to provide a measured roll angle and a measured roll rate of said body, and wherein said step of determining said first command comprises the steps of:

determining a desired roll angle for said body based on said lateral correction;

determining a desired roll rate for said body based on said desired roll angle and said measured roll angle; and determining said first command based on said desired roll rate and said measured roll rate.

3. A method according to claim 1 wherein said body is further equipped to provide a measured heading and a measured heading rate of said body, and wherein said step of determining said second command comprises the steps of:

determining a desired heading for said body based on said lateral correction;

determining a desired heading rate for said body based on said desired heading and said measured heading relative to said known direction of travel; and determining said second command based on said desired heading rate and said measured heading rate.

4. A method according to claim 1 wherein said body is further equipped to provide a measured depth of said body, said method further comprising the steps of:

providing a desired depth for said body;

determining a depth correction based on a difference between said desired depth and said measured depth;

determining a third command indicative of an elevator control that would cause said means for effecting to move said body vertically to maintain said body at said desired depth;

combining said third command and said combined command to define a second combined command; and applying said second combined command to said means for effecting.

5. A method according to claim 4 wherein said body is further equipped to provide a measured pitch angle and a measured pitch rate of said body, and wherein said step of determining said third command comprises the steps of:

determining a desired pitch angle based on said depth correction;

determining a desired pitch rate based on said desired pitch angle and said measured pitch angle; and determining said third command based on said desired pitch rate and said measured pitch rate.

6. A method according to claim 1 wherein said frame of reference is a Cartesian coordinate system.

7. A method of controlling the lateral position of a towed body in the water, comprising the steps of:

providing a body in water, said body being equipped with means for effecting aileron, elevator and rudder control thereof;

pulling said body through the water along a known direction of travel;

defining a Cartesian frame of reference having one axis along said known direction of travel;

defining a lateral correction to said known direction of travel in said Cartesian frame of reference, said lateral correction defined by a distance measured perpendicular to said one axis;

determining a first command indicative of an aileron control that would cause said means for effecting to move said body laterally of said direction of travel by an amount equal to said lateral correction;

determining a second command indicative of a rudder control that would cause said means for effecting to move said body laterally of said direction of travel by an amount equal to said lateral correction;

providing a measured depth and a desired depth for said body;

determining a depth correction based on a difference between said desired depth and said measured depth;

determining a third command indicative of an elevator control that would cause said means for effecting to move said body vertically to maintain said body at said desired depth;

combining said first command, said second command and said third command to define a combined command; and applying said combined command to said means for effecting.

8. A method according to claim 7 wherein said body is further equipped to provide a measured roll angle and a measured roll rate of said body, and wherein said step of determining said first command comprises the steps of:

determining a desired roll angle for said body based on said lateral correction;

determining a desired roll rate for said body based on said desired roll angle and said measured roll angle; and determining said first command based on said desired roll rate and said measured roll rate.

9. A method according to claim 7 wherein said body is further equipped to provide a measured heading and a measured heading rate of said body, and wherein said step of determining said second command comprises the steps of:

determining a desired heading for said body based on said lateral correction;

determining a desired heading rate for said body based on said desired heading and said measured heading relative to said known direction of travel; and determining said second command based on said desired heading rate and said measured heading rate.

10. A method according to claim 7 wherein said body is further equipped to provide a measured pitch angle and a measured pitch rate of said body, and wherein said step of determining said third command comprises the steps of:

determining a desired pitch angle based on said depth correction;

determining a desired pitch rate based on said desired pitch angle and said measured pitch angle; and determining said third command based on said desired pitch rate and said measured pitch rate.

* * * * *